United States Patent [19]

Reynard

[11] Patent Number: 4,648,636

[45] Date of Patent: Mar. 10, 1987

[54] CONTAINER LOCKING

[75] Inventor: Kenneth Reynard, Thirsk, Great Britain

[73] Assignee: George Blair PLC, Newcastle upon Tyne, Great Britain

[21] Appl. No.: 754,640

[22] Filed: Jul. 12, 1985

[30] Foreign Application Priority Data

Jul. 16, 1984 [GB] United Kingdom ..... 8418000

[51] Int. Cl.[4] ..... E05C 1/06; E05C 9/12

[52] U.S. Cl. ..... 292/39; 70/120; 292/DIG. 32

[58] Field of Search ..... 292/DIG. 32, 37, 39; 70/120

[56] References Cited

U.S. PATENT DOCUMENTS

| | | | |
|---|---|---|---|
| 497,581 | 5/1893 | Kirby | 292/37 |
| 1,338,689 | 5/1920 | Massoll | 292/39 |
| 3,110,512 | 11/1963 | Scalf et al. | 292/39 X |
| 4,142,390 | 3/1979 | Schroeder | 70/120 X |
| 4,142,747 | 3/1979 | Beck et al. | 292/37 |
| 4,288,944 | 9/1981 | Donovan | 292/39 X |

FOREIGN PATENT DOCUMENTS

| | | | |
|---|---|---|---|
| 11674 | of 1908 | United Kingdom | 292/39 |
| 902291 | 8/1962 | United Kingdom | 292/37 |

*Primary Examiner*—Robert L. Wolfe
*Assistant Examiner*—Russell W. Illich
*Attorney, Agent, or Firm*—Abelman Frayne Rezac & Schwab

[57] ABSTRACT

The hinged door of a cargo container is provided with a locking mechanism contained wholly or mainly within the thickness of the door to draw the door into a closed and sealed position with respect to its surronding door frame. In one arrangement the mechanism has a tapered locking bolt that can be slid into a receiving recess in the surrounding door frame such that engagement of one face of the bolt taper with the socket urges the door into its fully closed and sealed position as the bolt is extended into the recess, and when the bolt is retracted engagement of the recess with the opposite face of the bolt taper breaks the door seal. In another arrangement the mechanism has a rotary pin projecting into a cam track to effect locking engagement.

6 Claims, 7 Drawing Figures

CONTAINER LOCKING

BACKGROUND OF THE INVENTION

This invention relates to cargo containers and the locking means for the doors of such containers.

Standard cargo containers have hinged doors provided with a peripheral seal and to make the seal and hold such doors securely closed a degree of force must be applied in the final closing movement of the door through a cam and hinge plate mechanism secured to the outside of the door. Since the overall dimensions of the standard containers are fixed, these mechanisms take up space which might otherwise be available for carrying goods. Moreover, due to the rough handling cargo containers receive, the locking mechanisms are frequently damaged.

It is an object of the present invention to provide a locking mechanism for cargo containers which is able to avoid or at least mitigate these problems.

SUMMARY OF THE INVENTION

According to the present invention, there is provided a cargo container having at least one door with a locking mechanism arranged to draw the door into a closed and sealed position, said mechanism being contained wholly or mainly within the thickness of the door.

More particularly, the locking mechanism may comprise an engagement member at one edge of the door, disposed inwardly of an elastomeric peripheral door seal for engagement between the door and its surrounding frame, and the member may be received in a recess in said frame which comprises a bearing face for cooperation with the engagement member whereby displacement of the member into said recess slides it over said bearing face to draw the door to said closed and sealed position.

In one preferred form of the invention the mechanism comprises an inclined wedge bolt that is displaceable outwards from an edge of the door into the co-operating recess, formed e.g. by a staple in the surrounding door frame, the bolt so engaging the sides of the recess that as it moves over said sides into the recess it urges the door into the fully closed position in which the peripheral seal is firmly engaged, and conversely it breaks the seal as it moves out of the recess.

In an alternative form of the invention, similar functions may be obtained employing a rotary cam track and follower arrangement for the locking mechanism, for example, the follower being mounted on a crank projecting from an edge of the door to engage a fixed track in the adjacent frame, said crank being mounted on a guide whereby it and its follower move towards and away from the door edge as the crank is rotated.

The invention will be described in more detail by way of example with reference to the accompanying schematic drawings.

DESCRIPTION OF THE PREFERRED EMBODIMENTS

Figure 1:
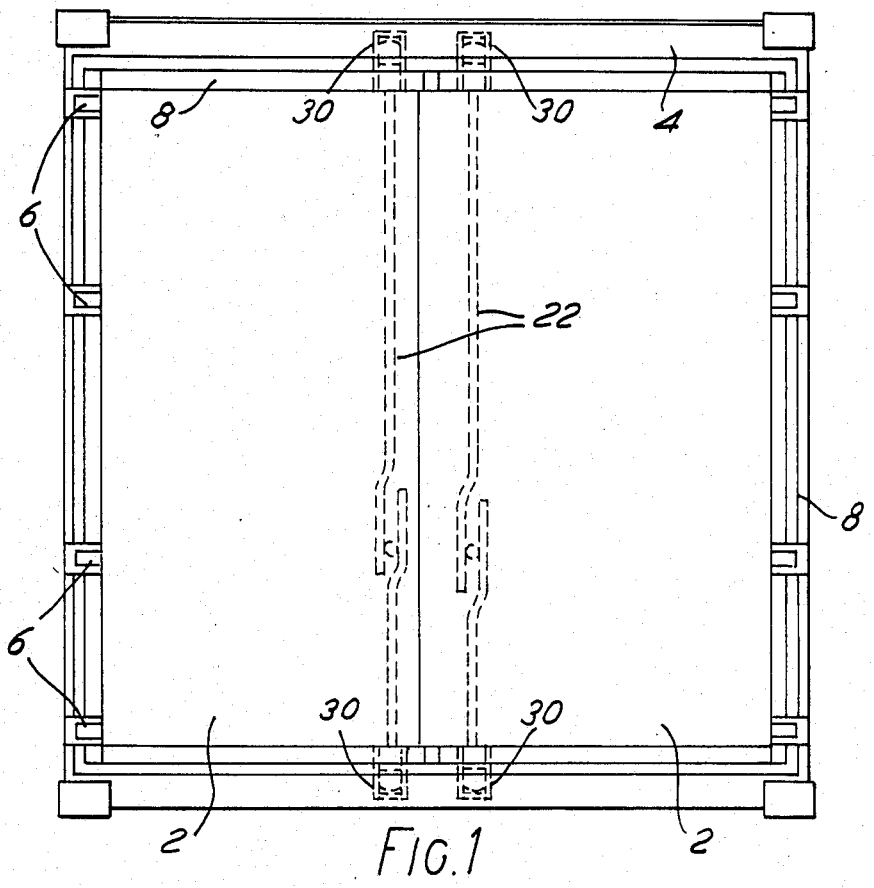
FIG. 1 is a rear view of a container having doors fitted with locking mechanisms according to the invention.
Figure 4:
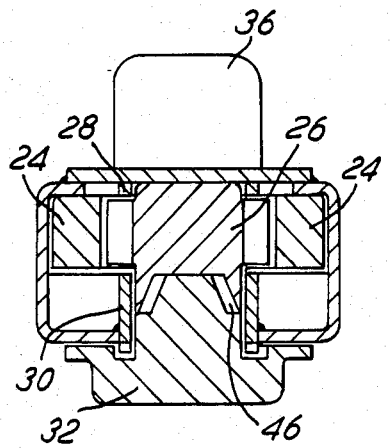
Figure 5:
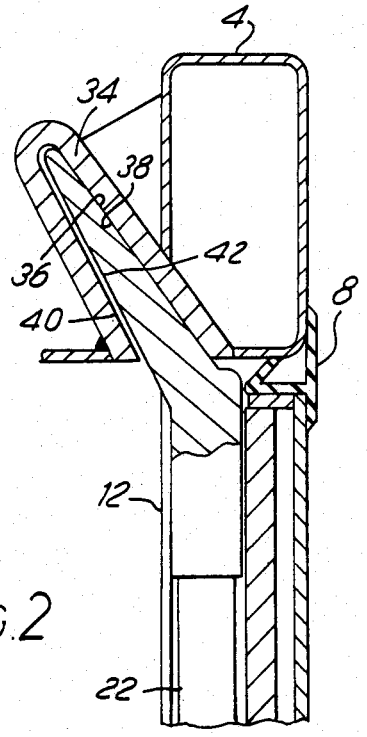
FIG. 5 is a detail illustration showing the engagement of one of the bolts of the mechanism of FIGS. 2 to 4 in the adjacent door frame.

FIG. 1 illustrates the rear of a cargo container with a pair of doors 2 fitting within a surrounding frame 4 on which they are mounted by hinges 6 at their outer edges. The door has peripheral elastomeric seals 8 of generally conventional form bonded to it which, in the fully closed position of the door, as indicated in FIG. 5, bridge the gap between door and frame and lie substantially flush with the outer surfaces of both. Each door also has a locking mechanism, shown in more detail in FIGS. 2–4.

Referring to these figures, each mechanism is contained in a post-like casing 12 which occupies the thickness of the door 2 at its inner edge and which may be an integral part of the door structure. Mounted in guides 14 of T-slot form at opposite ends of the casing are locking bolts 16 each having a carrier body 18 slidable in its guide and a wedge-form finger or horn 20 inclined obliquely towards the direction of the closing movement of the door and therefore projecting inwardly from the inner face of the door. For movement of the bolts along their guides, each is secured through its carrier body 18 to one end of a drive tube 22 extending along the interior of the casing. At their opposite ends the tubes each have an offset portion on which a toothed rack 24 is fixed and the two racks are disposed opposite each other to engage a common pinion 26 mounted between them on bearing bushes 28, 30. The pinion is rotated by the detachable security key 32 so as to drive the bolts outwards from the door together to engage respective staples or sockets 34 or like recesses in the surrounding door frame. The entry openings to these receiving recesses preferably lie at least partly within the thickness of the door.

Figure 3:
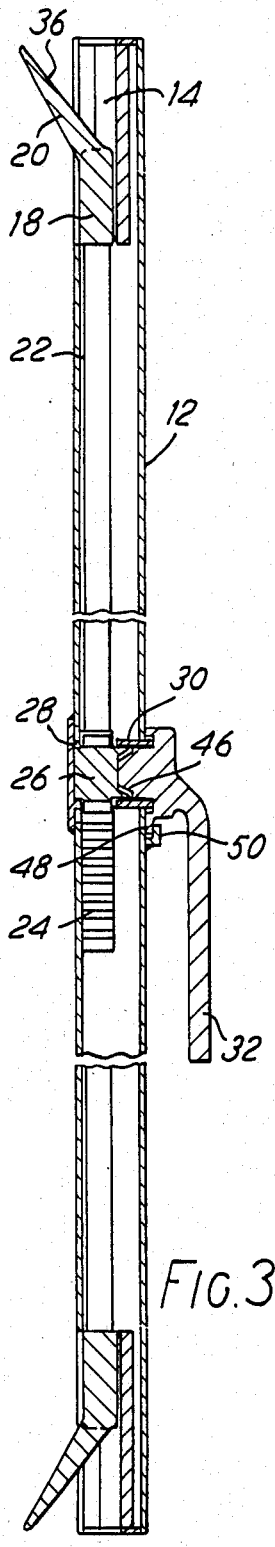
FIGS. 2 to 4 are a front view, and axial and transverse sections respectively of one of the locking mechanisms of FIG. 1.
Figure 2:
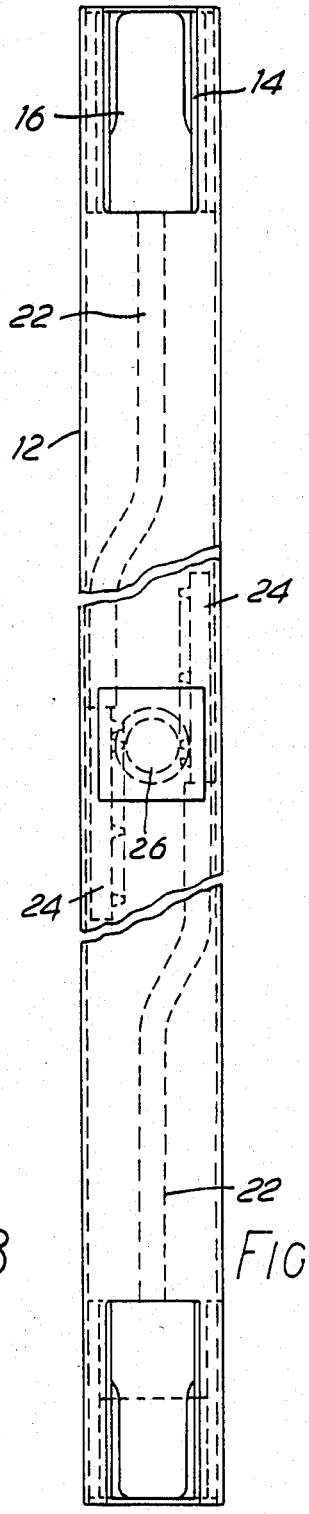

While the door is open the bolts are held in the retracted position shown in FIGS. 2 and 3 so that the door can be freely moved nearly to its closed position with the narrow outer end of the bolt finger directly opposite the wider entry to the opening in the face of the staple To lock the door, the pinion 26 is then rotated to move the drive tubes, and therefore the bolts, outwards. In a first part of the movement of a bolt outwards from the door its outer face 36 engages the opposed face 38 of the staple and in the remaining part of the movement it slides over the staple face in the manner of a wedge drawing the door firmly closed. When the door is to be reopened and the pinion is rotated in the opposite direction to draw the bolts inwards, there is a positive opening force provided by sliding contact between the inwardly inclined inside face 40 of the bolt and the opposed face 42 of the staple. That opening force is able to overcome any resistance caused by the seal before it is released.

As has already been mentioned, the locking mechanism is shown operated by the security key 32, although any conventional means of operation may be employed alternatively. In this illustrated example, the pinion 26 is provided with a frusto-conical toothed socket 46 engaged by the key when it is inserted from the exterior into the bush 30. A radial projection 48 on the operating key fits under an arcuate retaining flange 50 concentrically surrounding the greater part of the periphery of the bush 30. While the projection moves under the flange, the key is held in the socket. Only when the bolts have been fully driven home or have been fully retracted does the projection reach a position clear of the flange where it can be removed. Without a key that engages both the frusto-conical socket (to apply torque) and the retaining flange (to maintain engagement with the socket) the doors cannot be opened.

Figure 6A:
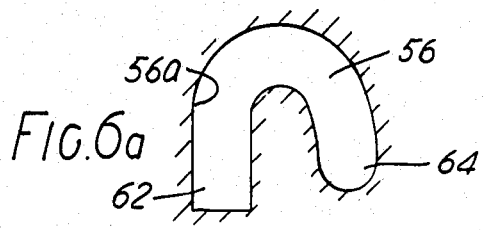
FIG. 6 illustrates the locking mechanism of another embodiment of the invention employing a cam track of the form shown in FIG. 6*a*.
Figure 6:
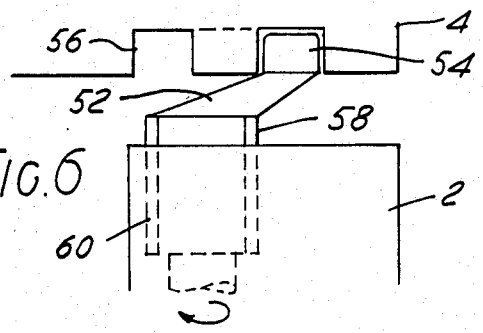

In FIG. 6, the locking mechanism comprises a rotary crank 52 carried by the door. A terminal follower pin 54 projects from the end of the crank to engage a cam track 56 forming a recess in the door frame, engagement with the sides 56*a* of the track locking the door closed. The crank centre bearing 58 is in the form of a lead screw in a helical carrier 60 in the door so that as it is rotated from the operative end position illustrated in FIG. 6, the pin is both displaced along the cam track and is also progressively withdrawn downwards from that track. In its fully retracted position, of course, it is completely clear of the door frame. As in the first example, corresponding locking mechanisms can be provided at both the top and bottom of the door and can be operated together by a common actuating drive.

As in that first example, the door is swung nearly to its fully closed position, at which stage the pin lies in register with, but clear of, the start of the cam track. When the actuating mechanism is operated to rotate the crank the pin moves upwards to enter the cam track at portion 62 and the door is drawn fully closed as the pin is engaged by the track and moves to the opposite end portion 64 where it holds the door locked.

It may be noted that the described mechanisms, being contained within the door, are protected from damage, both accidental and willful. In the first example, the bolt fingers project into the interior of the container, at least when retracted from their staples, but they are too small to affect the carrying capacity of the container. It will also be noted that since the mechanisms described are located in the inner side of the elastomeric seal, they are also given protection against corrosion by the elements.

Other forms of mechanisms can be used within the scope of the present invention. For example, whereas FIG. 6 shows rotation of a cam mechanism in a plane transverse to the plane of the door, it is also possible to provide a cam mechanism which rotates parallel to the plane of the door, or in a transverse, generally vertical plane.

Many different means may be employed to transmit motion to the locking mechanisms so that opposite pairs of mechanisms are driven together, including a conventional locking lever arrangement mounted on one door intended to be secured by a padlock or the like to the other door.

I claim:

1. In a cargo container having at least one generally planar outer door, a locking mechanism for engagement with the surrounding door frame or the like to draw the door into a closed and sealed position therewith, the door having inner and outer faces defining its thickness and said mechanism being contained at least mainly within said thickness of the door, the locking mechanism comprising an inclined bolt having opposite faces that are inclined in the same direction away from the outer face of the door and that converge towards each other with increasing distance from said outer face in the form of an inclined wedge, guide means in the door for locating said bolt displaceably whereby the bolt is extendable from an edge of the door, a cooperating recess in the surrounding door frame receiving said extended bolt, said recess having opposite faces for engagement by said faces of the bolt, whereby one opposed pair of faces of the bolt and the recess are engaged with a wedging action as the bolt moves into the recess, thereby to urge the door into the fully closed and sealed position, and the remaining opposed pair of faces of the bolt and recess cooperate with a wedging action to break the seal between the door and its frame when the bolt is retracted from the recess.

2. A cargo container according to claim 1 wherein an elastomeric peripheral seal is provided between the door and said surrounding frame, and said seal is disposed between the outer face of the door and said locking mechanism in the region of said engagement with the surrounding door frame or the like.

3. A cargo container according to claim 1 wherein said locking mechanism comprises a locking member extendable across a clearance between an edge of the door and an opposed face of said door frame when the door is closed, a receiving recess in said door frame receiving the extended locking member, the recess having a bearer face over which said member slides to draw the door to said closed and sealed position.

4. A cargo container according to claim 1 wherein the locking mechanism comprises means for initiating the opening movement of the door when said mechanism is disengaged from said door frame.

5. A cargo container according to claim 1 wherein the locking mechanism comprises corresponding locking members mounted at opposite edges of the door and a common driving means are carried by the door for said members, said driving means having means for operation by a security key.

6. A cargo container according to claim 1 wherein faces of the said recess for the bolt are of complementary form to said opposite faces of the wedge bolt.

* * * * *